US011696608B2

(12) United States Patent
Lagalante

(10) Patent No.: US 11,696,608 B2
(45) Date of Patent: Jul. 11, 2023

(54) REMOVABLE MAGNETIC CLOSURE SYSTEM FOR ARTICLES

(71) Applicant: Ayden John Lagalante, West Chester, PA (US)

(72) Inventor: Ayden John Lagalante, West Chester, PA (US)

(73) Assignee: Ayden John Lagalante, West Chester, PA (US)

( * ) Notice: Subject to any disclaimer, the term of this patent is extended or adjusted under 35 U.S.C. 154(b) by 0 days.

(21) Appl. No.: 17/304,335

(22) Filed: Jun. 18, 2021

(65) Prior Publication Data

US 2021/0392983 A1 Dec. 23, 2021

Related U.S. Application Data

(60) Provisional application No. 63/041,380, filed on Jun. 19, 2020.

(51) Int. Cl.
*A41F 1/00* (2006.01)
*A41D 27/20* (2006.01)

(52) U.S. Cl.
CPC ..... *A41F 1/002* (2013.01); *A41D 27/201* (2013.01)

(58) Field of Classification Search
CPC ..... A41F 1/002; A41D 27/201; Y10T 24/32; A44D 2203/00
See application file for complete search history.

(56) References Cited

U.S. PATENT DOCUMENTS 3,102,314 A * 9/1963 Alderfer ..... A41F 1/002 40/621
4,399,595 A * 8/1983 Yoon ..... A41F 1/002 24/303
5,604,960 A * 2/1997 Good ..... A41F 1/002 24/66.1
5,682,653 A * 11/1997 Berglof ..... G09F 1/10 224/183
6,035,449 A * 3/2000 Galler ..... A41D 27/20 2/249
6,146,324 A * 11/2000 Engel ..... A61N 2/02 600/15
6,226,842 B1 * 5/2001 Wong ..... A45C 13/1069 24/66.1

(Continued)

*Primary Examiner* — Robert Sandy
*Assistant Examiner* — Rowland Do

(57) ABSTRACT

A removeable, magnetic closure system for openings in clothing articles, in particular pockets, incorporating two fasteners that are held in place on opposite sides of the openings in clothing articles through intra-fastener magnetic attraction. Independent self-closure occurs through an inter-fastener magnetic attraction. Insertion of an object at the position of the openings in the clothing articles, in particular a pocket, increases the intra-fastener distance and reduces the intra-fastener attraction. When the object is removed, the openings in the clothing articles, in particular a pocket, are independently closed when the inter-fastener magnetic attraction is reestablished. Each fastener is removed from the openings in the clothing articles by 90-degree rotation of the intra-fastener geometry. The removable, magnetic closure system can be installed and removed indefinitely on different clothing articles.

15 Claims, 4 Drawing Sheets

(56) References Cited

U.S. PATENT DOCUMENTS

| | | | | |
|---|---|---|---|---|
| 6,301,754 | B1 * | 10/2001 | Grunberger | A41F 1/002 24/303 |
| 9,936,752 | B2 * | 4/2018 | Calvert | A41F 1/002 |
| 2005/0102802 | A1 * | 5/2005 | Sitbon | A45C 13/1069 24/303 |
| 2007/0028367 | A1 * | 2/2007 | Allen | A41D 27/145 2/244 |
| 2012/0079688 | A1 * | 4/2012 | Bunting | H01F 7/0252 24/303 |
| 2012/0216374 | A1 * | 8/2012 | Manuello | A41F 1/002 24/303 |
| 2014/0259266 | A1 * | 9/2014 | Federlin | A41F 1/002 2/69 |
| 2017/0234340 | A1 * | 8/2017 | Pensak | A41F 1/002 24/3.1 |

* cited by examiner

REMOVABLE MAGNETIC CLOSURE SYSTEM FOR ARTICLES

CROSS-REFERENCE TO RELATED APPLICATIONS

63/041,380 filing date: Jun. 19, 2020

FIELD OF THE INVENTION

The present invention relates to a functional, removable, and reusable closure system. In particular, the invention relates to a removable, non-permanent, material closure system that provides facile opening and independent self-closure. The system is particularly useful as a closure or joining mechanism for openings of articles such as clothing and apparel that contain pockets or openings.

BACKGROUND OF THE INVENTION

Articles containing openings, such as pockets on clothing and pouches on handbags, are often functionalized to provide closure to protect the contents inside the enclosure from falling out and inadvertent loss. This functionalization has typically included, but is not limited to, the use of zippers, snaps, buttons, clasps, Velcro, or string ties or other means of closure. These examples represent a permanent or semi-permanent addition to the opening during the manufacturing process or afterward through sewing or tailoring of the opening. Furthermore, multiple steps are necessary to retrieve or insert items into traditional closure systems. In the case of insertion, a first step is to unzip or unsnap the opening; a second step is to insert the item; a third step is to zip-up or snap the opening to a closed position. Many existing closure systems require the use of both hands by the user.

Desirable closure systems include the safe storage of contents placed in the article, opening and closing with a single hand in a single motion, and a small visual footprint on the article. Devising temporary, removable closures for openings without a closure system typically requires sewing or fastening of a closure mechanism to the existing article. Such additions can be considered permanent or semi-permanent additions to the article that can only be reversed through tedious and time-consuming removal of the added closure mechanism and potential damage to the article during removal of the closure system. Such added closures are therefore not rapidly or easily interchanged between different articles and are therefore not considered removable and reusable.

SUMMARY OF THE INVENTION

The present invention relates to a functional, removable, and reusable closure system. In particular, the invention relates to a removable, reusable, material closure system that provides facile attachment and removal, opening, and independent self-closure. The system is particularly useful as a closure or joining mechanism for the pockets or openings of clothing and apparel.

In certain embodiments, the present invention is comprised of two removable fasteners; each removable fastener containing two pieces. Each piece of a single removable fastener is magnetically attached through the material of the article by opposing magnetic polarities of the pieces. The two removable fasteners are magnetically attracted to each other and form an independent self-closure system for the article opening. In preferred embodiments, the two removable fasteners are used to provide easy opening and closure of a pocket or opening such as those found in clothing and apparel. The closure system is opened by simple insertion of a hand into the opening between the two removable fasteners, and as the hand is removed, the two removable magnetic fasteners provide independent self-closure of the opening. The system is rapidly and easily interchanged between articles by removing the two fasteners from the article and transferring the removable fasteners to a different article. The system requires no permanent or temporary modifications to the article to add the removable fasteners to the article and can be considered reversible and temporary in use.

In certain embodiments, the removable intra-fastener magnetic attraction is at least 3 times the inter-fastener magnetic attraction. In other embodiments, the removable intra-fastener magnetic attraction can be increased by addition of a layer of material that is magnetic or magnetizable. This layer intensifies the magnetic field on the opposite poles of the removable magnetic fastener pieces resulting in greater intra-fastener magnetic attraction.

In certain embodiments, the magnets of the removable fastener are enclosed in a non-magnetic material to tune the inter-fastener magnetic attraction. Customization of the non-magnetic enclosure thickness provides inter-fastener control of the magnetic pull force. Enclosures can be customized to provide identification or for decorative purposes.

Other features and advantages of the present invention will be understood by reference to the drawings and detailed description that follow.

BRIEF DESCRIPTION OF THE DRAWINGS

Some embodiments of the present invention are illustrated as an example and are not limited by the figures of the accompanying drawings, in which like references may indicate similar elements and in which:

FIG. 1—Side views of embodiments of the invention.

FIG. 2—Embodiments of the invention for self-closure of articles.

FIG. 3—Illustration of the sequence to attach two removable fasteners on a pocket of a pair of pants.

FIG. 4—FIG. 4 illustrates the opening and independent self-closure of a pocket by insertion and removal of a single hand.

DETAILED DESCRIPTION OF THE INVENTION

Figure 1A:
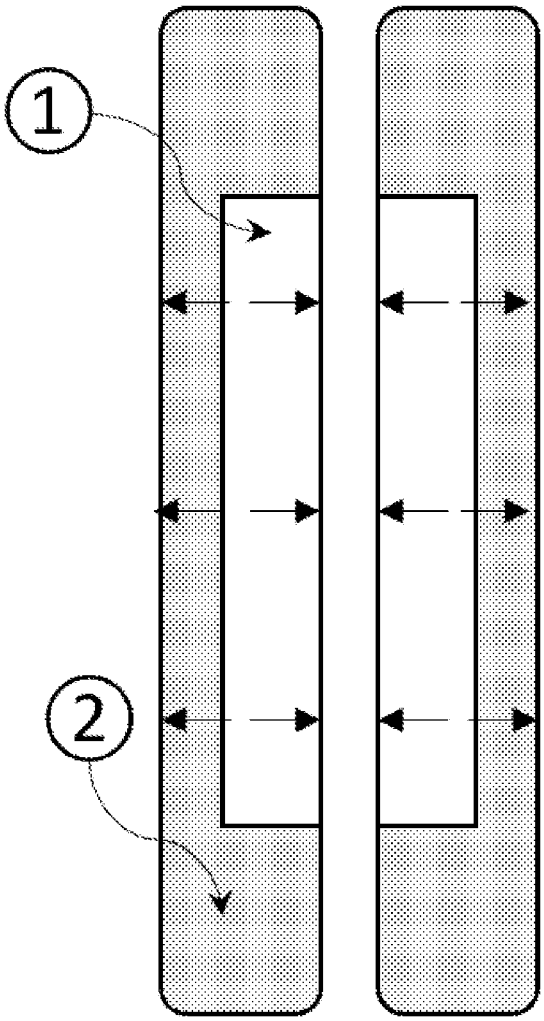
FIG. 1A illustrates a side view of a single removable fastener. Horizontal arrows in the drawing represent the magnetic pull force of a single removable fastener where the exposed magnet face exhibits a greater pull force than the enclosed magnet face.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

As used herein, the term "about" means within 10% of the reported numerical value, preferably within 5% of the reported numerical value.

As used herein, the term "magnet" means any material or object that contains an intrinsic magnetic field.

As used herein, the term "magnetic material" or "magnetizable" means any material that is attracted to magnets.

As used herein, the term "non-magnetic material" or "non-magnetizable material"means any material that is not attracted to magnets.

As used herein, the term "independent self-closure" means that a physical manipulation or action on the part of the user is not required for the closure mechanism to occur.

As used herein, the term "intra-fastener" means between the two pieces that make up a single fastener.

As used herein, the term "inter-fastener" means between two fasteners.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

The present disclosure is to be considered as an exemplification of the invention and is not intended to limit the invention to the specific embodiments illustrated by the figures or description below.

The system contains at least two fasteners that are temporarily held in place on the article through inter-fastener magnetic attraction. Alternately, the system contains at least two removable fasteners containing one or more intensification layers that are temporarily held in place on the article through inter-fastener magnetic attraction.

A removable fastener contains two pieces. Each piece contains a magnet. Non-limiting examples of suitable magnets are: (1) ceramic (also referred to as ferrite), composed of a sintered composite of powdered iron oxide and barium/strontium carbonate ceramic; (2) alnico, made casting or sintering aluminum, nickel and cobalt with iron and, optionally, small amounts of other elements; and (3) alloys of rare earth (lanthanide) elements, such as samarium-cobalt or neodymium-iron-boron (NIB) alloys. Also suitable for various embodiments of the present invention are: (4) injection-molded magnets, which are composites of resins and magnetic powders and resemble plastics in their physical properties; and (5) flexible magnets comprising magnetic powders and flexible resins (e.g., vinyl), which can be produced in flat strips, shapes or sheets.

The magnet is embedded within a non-magnetic or non-magnetizable material such that one polarity face of the magnet is exposed or partially exposed, and the opposite polarity face is embedded, or partially embedded, in the non-magnetic material. Non-limiting examples of suitable nonmagnetic materials are: polymers (e.g. polyurethanes, high density polyethylene (HDPE), low density polyethylene (LDPE), polytetrafluoroethylene (PTFE), polyethylene terephthalate (PET), polycarbonate, silicones), wood, or non-magnetic metals. The cross-sectional thickness of the nonmagnetic material will determine the inter-fastener magnetic attraction as a greater thickness will lead to a greater inter-fastener distance and less inter-fastener magnetic attraction. Nonmagnetic enclosure materials can include decorations, including but not limited to, color, text, or designs that are unique for identification of the device pieces. An embodiment of this is shown in FIG. 1A depicting a magnet (1) embedded in a non-magnetic enclosure (2) that comprises two pieces of a single fastener. The first piece and second piece of the removable fastener are attracted through the intra-fastener magnetic attraction of the exposed magnet surfaces of opposite polarity. In certain embodiments, the intra-fastener pull force of FIG. 1A is at least 13 Newtons.

Figure 1B:
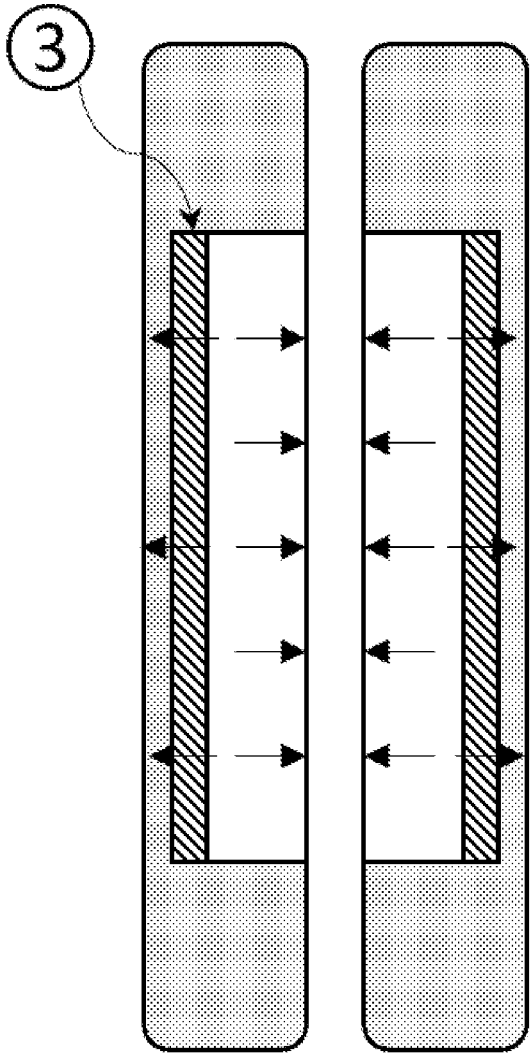
FIG. 1B illustrates a side view of a single removable fastener with a magnetic field intensifier layer. Horizontal arrows in the drawing represent the magnetic pull force of a single removable fastener where the pull force is enhanced on the exposed magnet face relative to the magnetic pull force depicted in FIG. 1A.

FIG. 1B depicts the fastener of FIG. 1A with an optional intensification layer (3) that increases the pull force on the exposed magnet face, relative to the magnetic pull force without the optional intensification layer, resulting in a greater intra-fastener magnetic attraction. The intensification layer can be a magnet of identical or different composition, or a magnetic material (e.g. iron) that is placed in contact with the face of the magnet that is enclosed in the non-magnetic material. In certain embodiments, the addition of this intensifier layer of FIG. 1B results in an intra-fastener pull force of about 1.3 times increase over the pull force without the intensifier layer of FIG. 1A. In preferred embodiments, the addition of this intensifier layer of FIG. 1B results in about 1.5 times increase over the intra-fastener pull force without the intensifier layer of FIG. 1A.

Figure 2A:
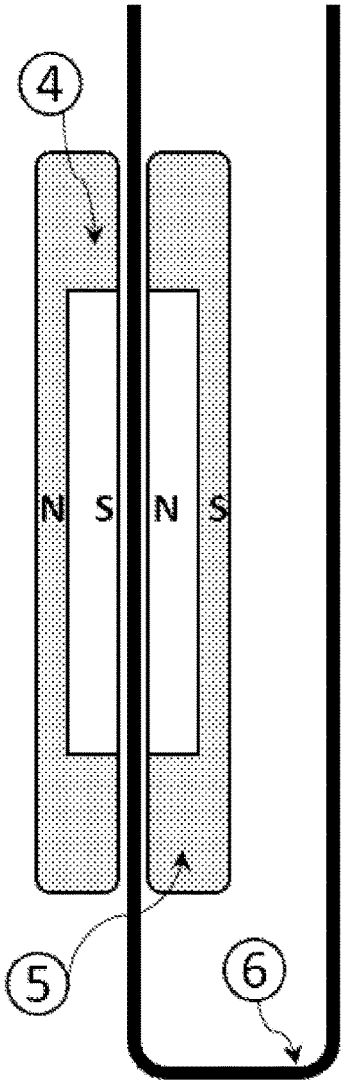
FIG. 2A illustrates a side view of the two halves of a single removable fastener attached through material on one side of a pocket.
Figure 2B:
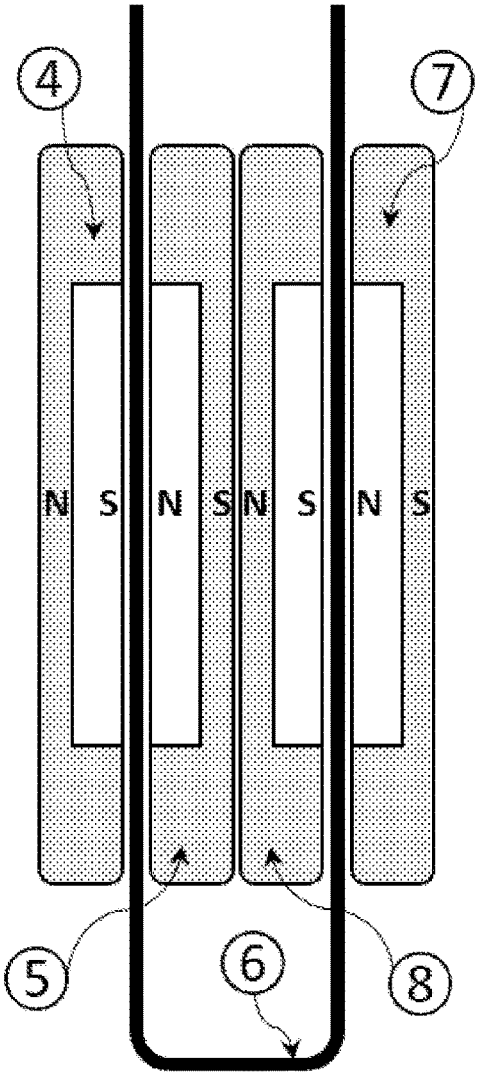
FIG. 2B illustrates a side view of two removable fasteners attached through opposing sides a pocket opening for self-closure of the material sides.

FIG. 2A depicts a removable fastener composed of two pieces (4) and (5) held in place by magnetic attraction through material of a pocket (6). Here, removable fastener piece (4) is on the interior-facing side of the pocket and removable fastener piece (5) is placed on one side of the pocket opening where one would insert a hand. The opposing magnetic poles of the magnet surface (N) and (S) are shown such that the intra-fastener attraction is sufficiently strong as to hold the removable fastener in place with a material held between the two pieces of the removable fastener. In certain embodiments, materials typical of clothing and accessories, including but not limited to, cloth, fabric, leather, and synthetic polymers are held between the two pieces of the removable fastener. Rotating one piece of a single removable fastener by 90 degrees about the central axis decreases the intra-fastener attraction by about 4.5 times. This rotation and reduction of intra-fastener attraction allows simple, hand separation of the two fastener pieces in comparison to pulling the two pieces apart with the magnetic faces aligned at 0 degrees which requires substantial pull force by the user. Thus, while in use, the removable intra-fastener magnetic attraction is strong with material sandwiched between the two pieces, and a simple 90-degree twist of one of the removable fastener pieces permits rapid and simple removal of the removable fastener from the material held between the two pieces. This change in geometry of the fastener pieces enables the intended temporary use of the fastener and easy removal and placement of the fastener on a different article. FIG. 2B depicts a first removable fastener (4, 5) and a second removable fastener (7,8) attached to opposite sides of a pocket opening (6). The (S) magnetic pole on the backside of fastener (5) is attracted to the (N) magnetic pole on the backside of fastener (8) to form the inter-fastener attraction that forms the independent self-closure of the pocket. In certain embodiments, the intra-fastener to inter-fastener ratio is about 3:1. The inter-fastener attraction can be adjusted with the thickness of the non-magnetic material enclosure and the composition and mass of the intensification layer.

Figure 3A:
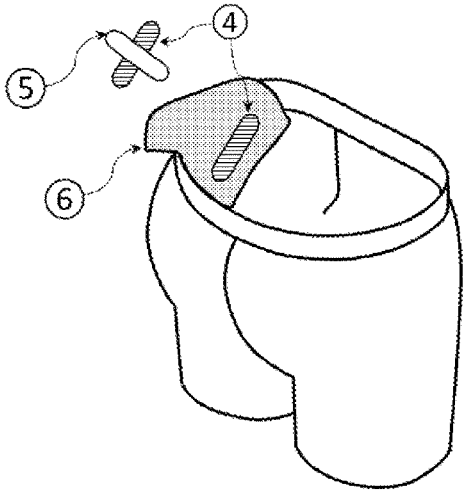
FIG. 3A illustrates a piece of a removable fastener is placed in the front-facing interior side of the pocket from the interior of the pants.
Figure 3B:
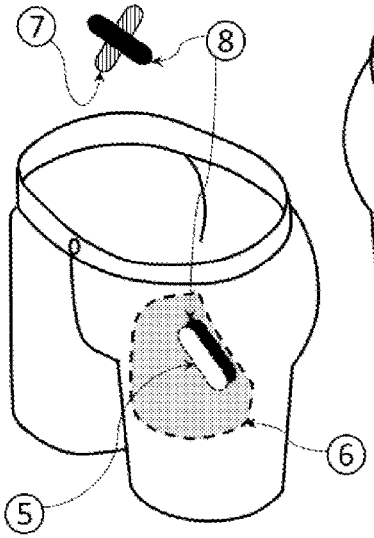
FIG. 3B illustrates placement of the magnetically opposing piece of the fastener in the pocket interior followed by positioning a piece of the second fastener in the pocket interior such that the two interior pieces exhibit inter-fastener attraction through the backsides of the removable fasteners.
Figure 3C:
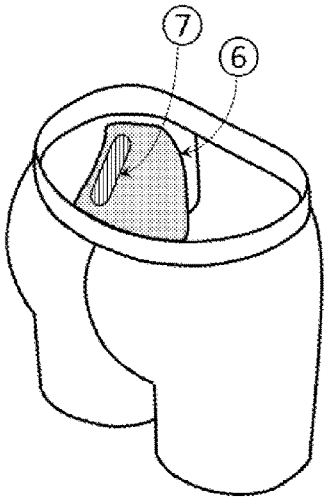
FIG. 3C illustrates placing the opposing piece from the second removable fastener pair in the rear-facing interior side of the pocket from the interior of the pants.

FIG. 3 describes the placement of two removable fasteners in a pants pocket. FIG. 3A depicts a 90 degree rotation of pieces (4) and (5) of the first removable fastener to separate pieces (4) and (5). After pulling pieces (4) and (5) apart, fastener piece (4) is placed in the front-facing interior side of the pocket (6). FIG. 3B depicts placement of the second piece (5) of the first removable fastener on the front-facing opening of the pocket (6) thus creating a matched removable fastener pair (4,5) of FIG. 2A. Then, the second removable fastener is separated by rotating pieces rotating pieces (7) and (8) by 90 degrees about the center axis. After pulling pieces (7) and (8) apart, piece (8) is placed in the rear-facing opening of the pocket (6) such that pieces (5) and (8) create the inter-fastener attraction. FIG. 3C depicts attachment of piece (7) on the rear-facing side of the pocket interior side of the pocket (6) to complete the second removable fastener and produce the pocket closure system depicted in FIG. 2B. Removal of the two fasteners from the pants pocket is achieved by rotating pieces (4) and (5) by 90 degrees about the center axis and pulling pieces (4) and (5) apart to remove the first removable fastener from the pocket material and subsequently rotating pieces (7) and (8) by 90 degrees about the center axis and pulling pieces (7) and (8) apart to remove the second removable fastener from the pocket material. The removal of the fasteners is accomplished without damage to the article and the involvement of any additional materials or skill on the part of the user.

Figure 4A:
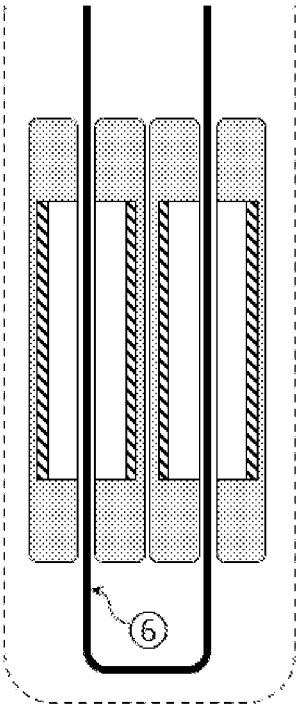
FIG. 4A illustrates a closed pocket prior to hand insertion.
Figure 4B:
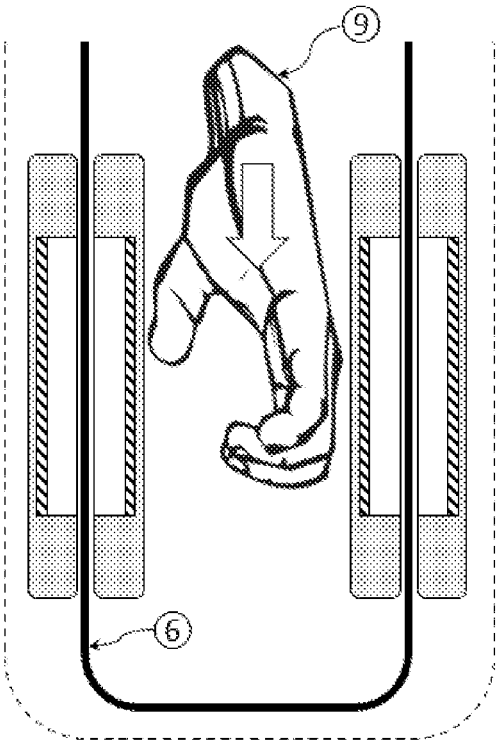
FIG. 4B illustrates the open pocket as a hand is inserted between the two removable fasteners to disrupt the inter-fastener attraction.
Figure 4C:
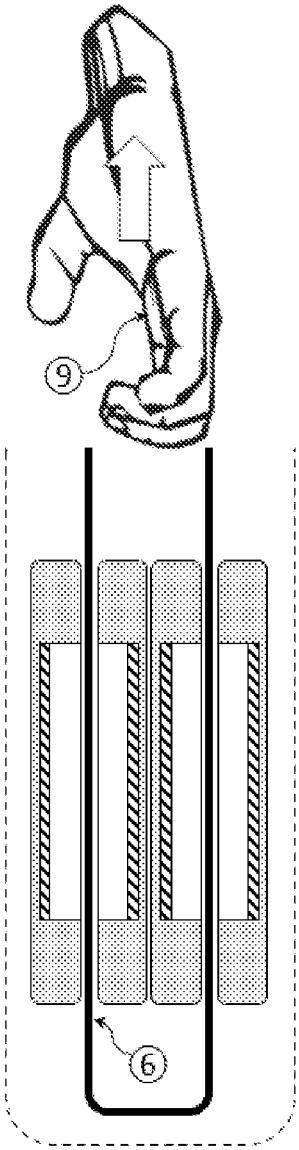
FIG. 4C illustrates the independent self-closing of the pocket once a hand is removed from the pocket.

FIG. 4 illustrates the opening and independent self-closing of a pocket by insertion and removal of a single hand. FIG. 4A depicts a closed pocket prior to hand (9) insertion. FIG. 4B depicts displacement of the intra-fastener magnetic attraction and opening of the pocket (6) by a hand (9) inserted with a typical downward insertion force into the pocket. FIG. 4C depicts removal of the hand (9) from the pocket with a typical upward removal force and independent self-closure of the pocket by the two removable fasteners with reestablishment of the inter-fastener magnetic attraction.

What is claimed:

1. A removable magnetic system for temporarily joining a clothing article, comprising a first removable magnetic fastener and a second removable magnetic fastener, wherein a. each of said first and second removable magnetic fasteners is comprised of two magnetically opposed independent pieces containing magnets or magnetic materials such that the removable magnetic system is comprised of four independent magnetic pieces;

b. said first and second removable fasteners are attached on opposite sides of an opening in said clothing article by intra-fastener magnetic attraction, whereby independent self-closure of the opening in said clothing article is achieved through inter-fastener magnetic attraction by decreasing the distance between said first and second removable fasteners;

c. the system is configured to achieve opening of said closure by increasing the distance between said first and second removable fasteners to decrease the inter-fastener magnetic attraction and;

d. the four independent magnetic pieces of said first and second removable fasteners are removed from said clothing article by intra-fastener rotation wherein the magnetically opposing pieces of said first and second removable magnetic fastener are rotated relative to each other about a central axis to decrease the intra-fastener magnetic attraction.

2. The system of claim 1, wherein the magnetic poles of said four magnetically opposed independent pieces are oriented to provide intra-fastener attraction of the pieces within each of said first and second magnetic fasteners attached on opposite sides of an opening in said clothing article and inter-fastener attraction between said first and second magnetic fasteners.

3. The system of claim 1, further comprising a non-magnetic material, wherein some or all surfaces of said magnets or magnetic material of fastener pieces are embedded.

4. The system of claim 3, wherein said non-magnetic material includes polymer plastics, wood, or non-magnetic metals.

5. The system of claim 1, wherein the intra-fastener pull force is at least 13 Newtons.

6. The system of claim 1, wherein the inter-fastener pull force is at least 4 Newtons.

7. The system of claim 1, further comprising intensification layers, wherein said intensification layers are added to the magnet or magnetic material surface opposite the intra-fastener magnetic attraction.

8. The system of claim 7, wherein the added intensification layer increases the intra-fastener pull force by 1.5 times.

9. The system of claim 1, wherein each of said first and second removable magnetic fasteners are attached on opposing surfaces of a pocket opening.

10. The system of claim 1, wherein an object is placed between the removable fasteners to increase the distance between said first and second removable fasteners.

11. The system of claim 1, wherein the magnetically opposing pieces of each of said first and second removable magnetic fastener are rotated 90 degrees relative to each other about a central axis to decrease the intra-fastener magnetic attraction.

12. The system of claim 11, wherein said rotated pieces of each of first and second rotated fastener are removed by increasing the distance between magnetically opposing intra-fastener pieces.

13. The system of claim 12, wherein the removed magnetic fasteners are re-attached to a pocket.

14. The system of claim 1, wherein the intra-fastener magnetic attraction is greater than the inter-fastener magnetic attraction.

15. The system of claim 14, wherein the intra-fastener magnetic attraction is greater than 3 times the inter-fastener magnetic attraction.

* * * * *